US010512288B2

(12) United States Patent
Campbell, Jr.

(10) Patent No.: US 10,512,288 B2
(45) Date of Patent: Dec. 24, 2019

(54) MALE UNDERGARMENT WITH SELF-ADJUSTING POUCH

(71) Applicant: Clay Eugene Campbell, Jr., Atlanta, GA (US)

(72) Inventor: Clay Eugene Campbell, Jr., Atlanta, GA (US)

( * ) Notice: Subject to any disclaimer, the term of this patent is extended or adjusted under 35 U.S.C. 154(b) by 49 days.

(21) Appl. No.: 15/675,848

(22) Filed: Aug. 14, 2017

(65) Prior Publication Data

US 2019/0045851 A1 Feb. 14, 2019

(51) Int. Cl.
*A41B 9/02* (2006.01)
*A41B 9/14* (2006.01)

(52) U.S. Cl.
CPC ..... *A41B 9/023* (2013.01); *A41B 9/02* (2013.01); *A41B 9/14* (2013.01)

(58) Field of Classification Search
CPC ..... A41B 9/023; A41B 9/026
See application file for complete search history.

(56) References Cited

U.S. PATENT DOCUMENTS 3,207,155 A * 9/1965 Casey ..... A41B 9/02 2/403
4,377,008 A * 3/1983 Jung ..... A41B 9/023 2/403
5,226,179 A * 7/1993 Choi ..... A41B 9/023 2/403
2004/0049835 A1* 3/2004 Horikoshi ..... A41B 9/023 2/400
2005/0268380 A1* 12/2005 Sovell ..... A41B 9/023 2/400
2008/0109945 A1* 5/2008 Xia ..... A41B 9/023 2/403
2014/0059744 A1* 3/2014 Lin ..... A41B 9/023 2/403
2015/0047108 A1* 2/2015 Crissman ..... A41B 9/026 2/405
2016/0278438 A1* 9/2016 Polidan ..... A41B 9/001

FOREIGN PATENT DOCUMENTS

JP 2010047888 A * 3/2010

* cited by examiner

*Primary Examiner* — Daniel J Colilla

(57) ABSTRACT

Disclosed is a male undergarment that has an expandable pouch. The pouch expands as needed depending on the male's genitalia. The pouch has a horizontal elastic band one and two-third inches below the garment's waistband which enables the pouch to adjust as needed. This horizontal elastic band is to be a half an inch long and one cm width depending on the size of the pouch. This pouch also has a four technique fold of material to increase comfort in the pouch. The two components combined creates a pouch that expands to the male's need.

7 Claims, 2 Drawing Sheets

MALE UNDERGARMENT WITH SELF-ADJUSTING POUCH

The following is a tabulation of some prior art that presently appears relevant:

| U.S. Patents | | | |
|---|---|---|---|
| Pat. No. | Kind Code | Issue Date | Patentee |
| 9,687,030 | B2 | 2017 Jun. 27 | Bigney et al. |
| 7,958,571 | B2 | 2011 Jun. 14 | Kitsch et al. |
| 8,332,968 | B1 | 2012 Dec. 18 | Williams |

| U.S. Pat. Application Publications | | | |
|---|---|---|---|
| Publication No. | Kind Code | Publ. Date | Applicant |
| 20090106874 | A1 | 2009 Apr. 30 | Shlush |
| 20060162052 | A1 | 2006 Jul. 27 | Stankowski et al. |

FIELD OF THE INVENTION

The present invention relates to an article of clothing. More specifically the present invention relates to next-to-skin undergarments for men and boys. Example embodiments of the invention include briefs, hybrid boxer-briefs, trunks and bikini style underpants. Background Undergarments for men and boys are currently available in two distinct styles. They are those that are loosely fitting and those that are more snug. Loosely fitting undergarments, commonly known as boxers, are constructed in a rectangular shape made with cotton material extending downward from an elastic waistband. The cotton material extends downward to cover each leg to the mid-thigh region and may or may not include an opening in the front to allow for discharge of bodily fluids.

The more snug fitting undergarment for men and boys are constructed in a way that secures the male genitalia and scrotum tightly close to the body. These are also made of cotton but are additionally generally blended with a spandex or polyester material for increased elasticity. These aforementioned snug fitting garments come in a variety of styles and are generally distinguished from each other by how far the material extends down a wearer's leg and thigh. Of these the longest are the so-called hybrid boxer-briefs on which material extends from an elastic waistband to the upper thigh region. Next are trunks. The material on trunks extends from the elastic waistband to fully cover the male genitalia region in the front and buttocks in the rear but stops higher than does the boxer-brief.

Material on trunks extend to right below the buttocks. Briefs stop even higher. Like trunks, the material on briefs extend from the waistband to cover the genitals in the front and buttocks in the rear. However these stop to only partially cover the buttocks. Due to their construction, which secures male genitalia tightly against the body, snug fitting male undergarments suffer from many deficiencies. These deficiencies generally result from a high degree of contact between the scrotum and the inner-thigh causing friction and chafing while sitting, running, walking or doing other activities. Additionally, irritation in the groin area can result from increased moisture due to perspiration.

DESCRIPTION OF THE PRIOR ART

To address these deficiencies, which are primarily related to comfort, there have been disclosed in prior art several types of male undergarments constructed with a pouch designed to receive the genitals of the wearer. For example U.S. Pat. No. 9,687,030 which was issued to Bigney et. al. discloses the construction of a garment with a three dimensional pouch intending to receive the scrotum and penis whereby the scrotum and penis is protected from pinching between the thighs and thereby enhances comfort for the wearer.

U.S. Pat. No. 7,958,571 which was issued to Kitsch et. al. discloses the construction of a garment with an improved pouch and sidewalls for supporting genitalia and decreasing irritation due to skin-to-skin friction and chafing. This art relies on a pear-shaped breathable pouch to support its claim to improve comfort and support.

U.S. Pat. No. 8,332,968 issued to Williams pertains to a construction of men's boxer shorts, for enhanced comfort in the crotch and groin area, that allows for a longer inseam to create more room and manageability. This art discloses a method of construction akin to "sagging" for underwear as a way to cause comfort.

U.S. patent publication No. 2009/0106874 discloses a boxer-brief type garment that is constructed with a pouch that claims to minimize perspiration and irritation, absorb accidental leakage of fluid body waste, and eliminate exposure to fluid body waste. This is accomplished by adding a layer of absorbent material to the pouch.

Lastly, U.S. patent publication No. 2006/0162052 discloses a male undergarment with a receiving pouch that is aimed at reducing friction between the legs when a wearer is walking or running by maintaining the scrotum in a "fixed optimal position." The focus of relevant prior art has been to address issues of comfort stemming from contact of the penis or scrotum to the inner thigh or perineum, perspiration and accidental leakage. None of the aforementioned prior art even addresses a root cause of discomfort, namely discomfort that results from garments not tailored to male's having larger genitalia as well as discomfort that can occur during an erection. Some in the prior art even claim to be form fitting when in fact they are not. There remains a need for a truly form fitting pouch. In all prior art, the size of a garment is determined by the size of the wearer's waist. There remains a need for a truly form-fitting pouch that takes into account the various sizes of male genitalia.

The one-size fits all paradigm upon which all prior art is hinged ignores the fact that all males have differing sizes of genitalia, unrelated to the size of one's waist. Accordingly, a male with a very small waist can easily have much larger genitalia than a male with a larger waist. However, in all current constructions, the male with large genitalia and a small waist has his genitalia confined within a space not actually suited for him. Additionally, average man experiences approximately eleven erections a day during the day and several more at night. A male can experience extreme discomfort during an erection while wearing any undergarment in the prior art. There remains a need for an undergarment presents a solution to this problem as well.

SUMMARY OF INVENTION

The current invention introduces a novel construction for a male undergarment. This male undergarment includes a pouch for receiving the penis and scrotum of the wearer that expands and retracts depending on the size of the wearer's genitalia, thereby increasing comfort.

DETAILED DESCRIPTION OF THE INVENTION

The foregoing embodiment is considered illustrative only of the principles of the invention. This invention discloses a construction of a male undergarment with a pouch for receiving the penis and scrotum that self-adjusts depending on the size of the wearer's genitalia. An embodiment of this invention is achieved by adding a horizontal elastic band one and two-third inches below the garment's waistband. This horizontal elastic band is to be a half an inch long and one cm width. It also has a 4 fold construction of material in the pouch. This material is added to increase for comfort for the penis and scrotum. By adding the two components (i.e. the elastic band and the 4 fold construction), each component plays a role in adjusting the size of the pouch.

Figure 1:
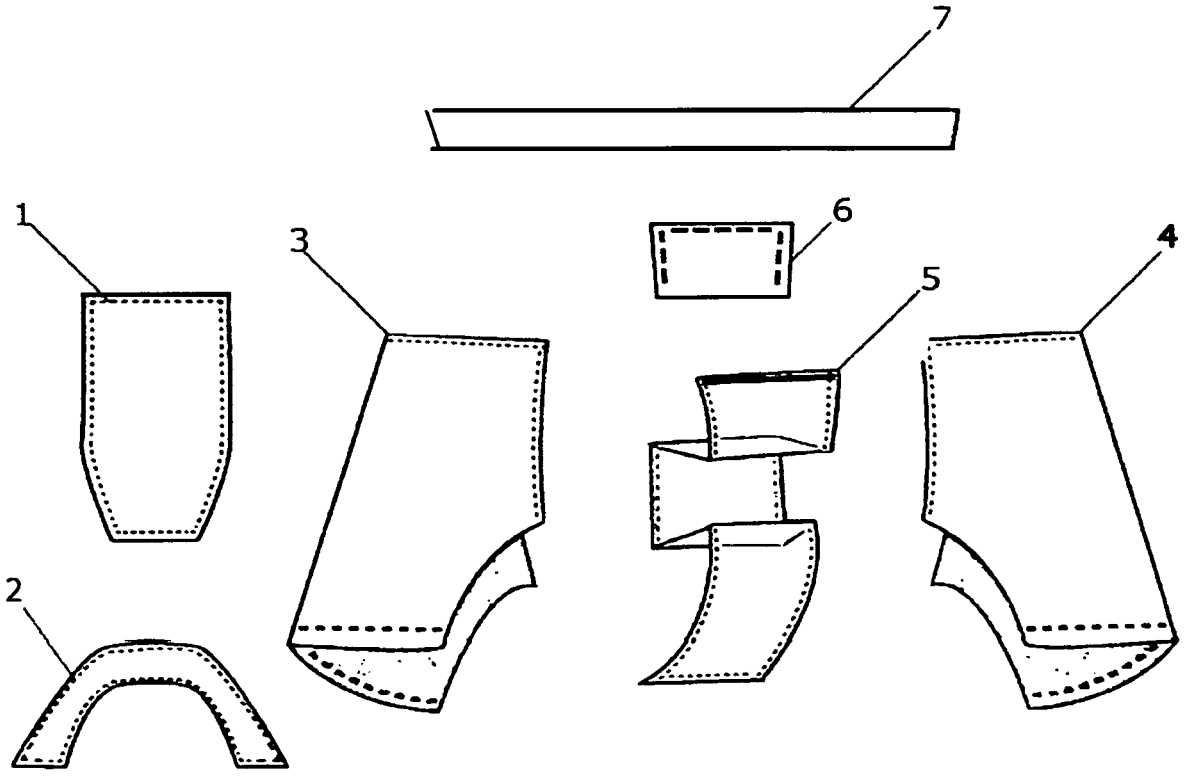
FIG. 1 shows an exploded view of a boxer brief broken down by seven different pieces

FIG. 1 shows a boxer brief broken down by seven different pieces. Each piece is stated below: 1. Rear Back Flap, 2. Gooch Flap, 3. Leg Panel, 4. Leg Panel, 5. Front Lower Pouch (front panel with four-fold construction), 6. Front Upper Slip (slip panel), and 7. Elastic Waistband.

Figure 2:
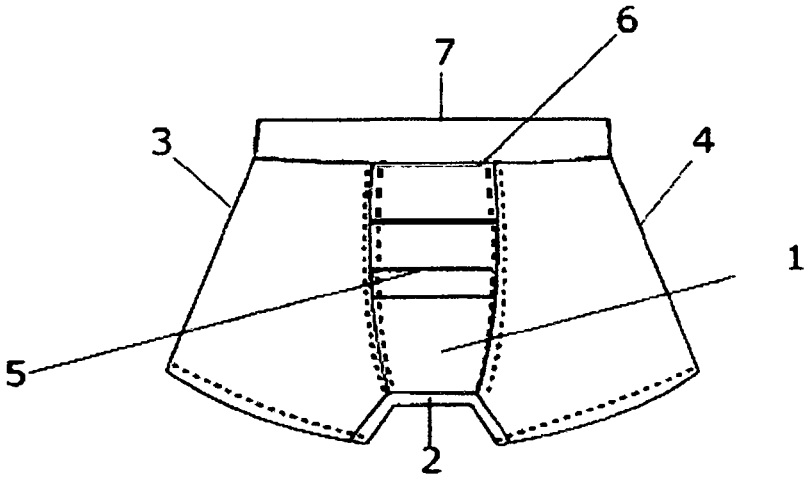
FIG. 2 shows a front view of a boxer brief once each part is connected.

FIG. 2 shows a front and back view of a boxer brief once each part is connected.

Figure 3:
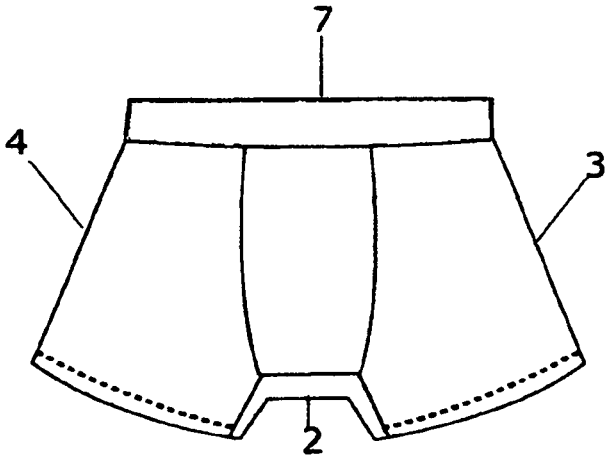
FIG. 3 shows a back view of a boxer brief once each part is connected.

FIG. 3 shows a back view of a boxer brief once each part is connected.

Note in FIG. 2 the front upper slip is to be placed behind the front lower pouch. This creates a slip/hole (slit) between the front upper slip and the front lower pouch. To create the front lower pouch a simple four-fold construction is provided. Note the front lower pouch is to be seamed and created with elastic material.

It will be apparent that the invention can be carried into practice with many modifications, variations and adaptations, and with numerous equivalents or alternative solutions that are within the scope of person skilled in the art, without departing from the spirit of the invention or exceeding the scope of the claims. It is therefore intended by this disclosure to cover any and all such modifications, applications, adaptations and embodiments within the scope of the present invention.

I claim:

1. A snug fitting undergarment comprising:

a right leg panel;

a left leg panel;

a rear back flap positioned between the right and left leg panels in the back of the undergarment;

a gooch flap positioned between the right and left leg panels on an underside of the undergarment; and a front panel positioned between the right and left leg panels on a front side of the undergarment, wherein the front panel is made from a single strip of material including four folds creating five sections in the front panel, wherein a top section and a bottom section of the five sections are stitched to the right leg panel and the left leg panel and three middle sections of the front panel create a pouch accommodating various sizes of genitals, wherein said undergarment allows for a custom fit that takes into account varying waist to genital sizes and allows for a snug fit that properly supports the genital area without requiring a wearer to make manual adjustment and without requiring a separate adjusting mechanism on the undergarment.

2. The snug fitting undergarment according to claim 1, wherein the undergarment is one of briefs, boxer briefs or another common type of male undergarment.

3. The snug fitting undergarment according to claim 1, further comprising:

a slip panel located above the front panel, wherein a bottom edge of the slip panel is adjacent a top edge of the front panel creating a slit between the slip panel and the front panel.

4. The snug fitting undergarment according to claim 1, wherein the pouch expands and retracts depending on the size of the wearer's genitals thereby increasing comfort.

5. The snug fitting undergarment according to claim 1, wherein the pouch is located in the center of the undergarment.

6. The snug fitting undergarment according to claim 1, further comprising:

a waistband located at a top of the undergarment, wherein the front panel is located one and two thirds inches below the waistband.

7. The snug fitting undergarment according to claim 1, wherein the front panel is created with an elastic material.

* * * * *